US005873422A

United States Patent [19]

Hansen et al.

[11] Patent Number: 5,873,422

[45] Date of Patent: Feb. 23, 1999

[54] ANTI-WHIRL DRILL BIT

[75] Inventors: Wayne R. Hansen, Centerville; Paul E. Pastusek, Salt Lake City, both of Utah; Jerry Cerkovnik, The Woodlands, Tex.

[73] Assignee: Baker Hughes Incorporated, Houston, Tex.

[21] Appl. No.: 197,011

[22] Filed: Feb. 15, 1994

Related U.S. Application Data

[63] Continuation of Ser. No. 883,667, May 15, 1992, abandoned.

[51] Int. Cl.[6] ..... E21B 10/46

[52] U.S. Cl. ..... 175/399; 175/408; 175/426

[58] Field of Search ..... 175/399, 398, 175/408, 426, 431

[56] References Cited

U.S. PATENT DOCUMENTS

| | | | |
|---|---|---|---|
| 4,932,484 | 6/1990 | Warren et al. | 175/329 |
| 4,982,802 | 1/1991 | Warren et al. | 175/57 |
| 5,010,789 | 4/1991 | Brett et al. | 76/108.2 |
| 5,042,596 | 8/1991 | Brett et al. | 175/57 |
| 5,090,492 | 2/1992 | Keith | 175/408 |
| 5,099,934 | 3/1992 | Barr | 175/408 |
| 5,109,935 | 5/1992 | Hawke | 175/434 |
| 5,119,892 | 6/1992 | Clegg et al. | 175/431 |
| 5,131,478 | 7/1992 | Brett et al. | 175/57 |
| 5,165,494 | 11/1992 | Barr | 175/399 X |
| 5,178,222 | 1/1993 | Jones et al. | 175/398 |
| 5,186,268 | 2/1993 | Clegg | 175/399 |

*Primary Examiner*—Hoang C. Dang
*Attorney, Agent, or Firm*—Trask, Britt & Rossa

[57] ABSTRACT

An anti-whirl rotary drag bit including one or more cutters, wear knots or other support structures disposed on the flank of a bit profile in a normally cutter-devoid region of the profile adjacent the gage of the bit in the circumferential segment of the gage used as a bearing zone for the bit to ride against the side of the bore hole. Such flank cutters or other structures reduce wear of the bearing zone but, due to their placement, do not come into play except under certain drilling situations such as reaming or high rates of penetration wherein whirl tendencies resulting from cutting forces are not as pronounced.

5 Claims, 4 Drawing Sheets

ANTI-WHIRL DRILL BIT

This is a continuation; application under 37 CFR 1.62 of prior application Ser. No. 07/883,667, filed on May 15, 1992, now abandoned.

BACKGROUND OF THE INVENTION

1. Field of the Invention

This invention relates generally to fixed cutter rotary drag bits for earth boring, and more particularly to improvements in bit design for so-called "anti-whirl" bits.

2. State of the Art

Fixed cutter rotary drag bits for subterranean earth boring have been employed for decades. It has been found that increasing the rotational speed of such drill bit has, for a given weight on bit, increased the rate of penetration of the drill string. However, increased rotational speed also has tended to decrease the life of the drill bit due to premature damage to and destruction of cutting elements, commonly polycrystalline diamond compacts (PDC's).

It has recently been recognized that cutting element destruction, particularly at higher rotational speeds, is at least in part attributable to a phenomenon known as "whirl" or "bit whirl." Radially directed centrifugal imbalance forces exist to some extent in every rotating drill bit and drill string. Such forces are in part attributable to mass imbalance and in part to dynamic forces generated by contact of the drill bit with the formation. In the latter instance, aggressive cutter placement and orientation creates a high tangential cutting force relative to the normal force and aggravates the imbalance. In any event, these imbalance forces tend to cause the drill bit to rotate or roll about the bore hole in a direction counter to the normal direction of rotation imparted to the bit during drilling. This counter-rotation is termed "whirl," and is a self-propagating phenomenon, as the side forces on the bit cause its center of rotation to shift to one side, after which there is an immediate tendency to shift again. Since cutting elements are designed to cut and to resist impact received in the normal direction of bit rotation (clockwise, looking down), contact of the cutting elements with the bore hole wall in a counter-clockwise direction due to whirl places stresses on the cutting elements for which they were never designed.

One solution to the problems caused by bit whirl has been to focus or direct the imbalance forces as a resultant side force vector to a particular side of the bit via changes in cutting element placement and orientation and bit mass location, and to cause the bit to ride on a low-friction bearing zone or pad on the gage of that side of the bit, thus substantially reducing the drill bit/bore hole wall tangential forces which induces whirl. This solution is disclosed in numerous permutations and variations in U.S. Pat. Nos. 4,982,802; 4,932,484; 5,010,789 and 5,042,596, all assigned to Amoco Corporation of Chicago, Ill.

The above-referenced patents generally require that the low friction bearing zone or pad on the gage and adjacent bit profile or flank be devoid of cutters, and indeed many alternative bearing zone configurations are disclosed, including wear coatings, diamond stud inserts, diamond pads, rollers, caged ball bearings, etc. It has been suggested that the bearing zone on the bit gage may include cutting elements of different sizes, configurations, depths of cut and/or rake angles than the cutters located in the cutting zone of the bit, which extends over the bit face from the center thereof outwardly to the gage, except in the flank area of the face adjacent the bearing zone. However, it is represented in the prior art that such bearing zone cutters should generate lesser cutting forces than the cutters in the cutting zone of the bit so that the bearing zone will have a relatively lower coefficient of friction. See U.S. Pat. No. 4,982,802, Col. 5, lines 29–36; U.S. Pat. No. 5,042,596, Col. 4, lines 18–25.

While anti-whirl bits have been built according to the aforementioned designs, the use of a cutter-devoid bearing zone and adjacent profile has resulted in excessive wear of the bearing zone as well as of the cutters on the flank of the bit, which shortens bit life even when cutting elements still have significant life remaining. This problem manifests itself most dramatically when the bit has to ream to reach the bottom of the hole.

Therefore, in order to take full advantage of the anti-whirl bit concept, it would be desirable to possess an anti-whirl drill bit having cutters placed on the bit profile adjacent the bearing zone of the bit in such a manner that the reaming capabilities and wear resistance of the bit to high side loads is enhanced without adversely affecting the anti-whirl tendencies of the bit.

SUMMARY OF THE INVENTION

The present invention comprises an anti-whirl, fixed cutter drag bit having cutters placed on the profile adjacent the bearing zone of the bit. More specifically, cutters are placed on the flank adjacent the bearing zone so as to protrude or extend from the face or profile of the bit a distance less than that of the remaining cutters on the bit face, i.e., those in the "cutting zone" of the bit. With such a configuration, these "bearing zone flank cutters" on the flank of the bit face only come into contact with the formation when the cutting zone cutters dull and the bit has a reduced tendency to whirl, or when the cutting zone cutters achieve relatively high depths of cut, such as when reaming or under high rates of penetration.

As the cutting zone cutters wear or the bit achieves a high rate of penetration, the bearing zone flank cutters on the profile flank engage the formation, prevent wear of the bearing zone and greatly extend bit life.

Several alternative bearing zone flank cutter placement schemes are contemplated, the first being highly aggressive cutters, such as neutral rake cutters (perpendicular to the bit profile) extending from the profile a lesser distance than the cutting zone cutters. A second alternative comprises bearing zone flank cutters of high backrake relative to the cutting zone cutters, the increased backrake decreasing the distance or height of the cutter edge from the profile.

It is also contemplated that bearing zone flank cutters with grind flats at their top or outer edge might be employed, or penetration limiters such as natural diamonds or diamond-impregnated studs may be placed in front of or behind the bearing zone flank cutters to control the cutting forces generated adjacent the bearing zone. Finally, reduced-height standoffs or wear bumps may be placed on the flank adjacent the bearing zone in lieu of cutters.

DETAILED DESCRIPTION OF THE PREFERRED EMBODIMENTS

Figure 1:
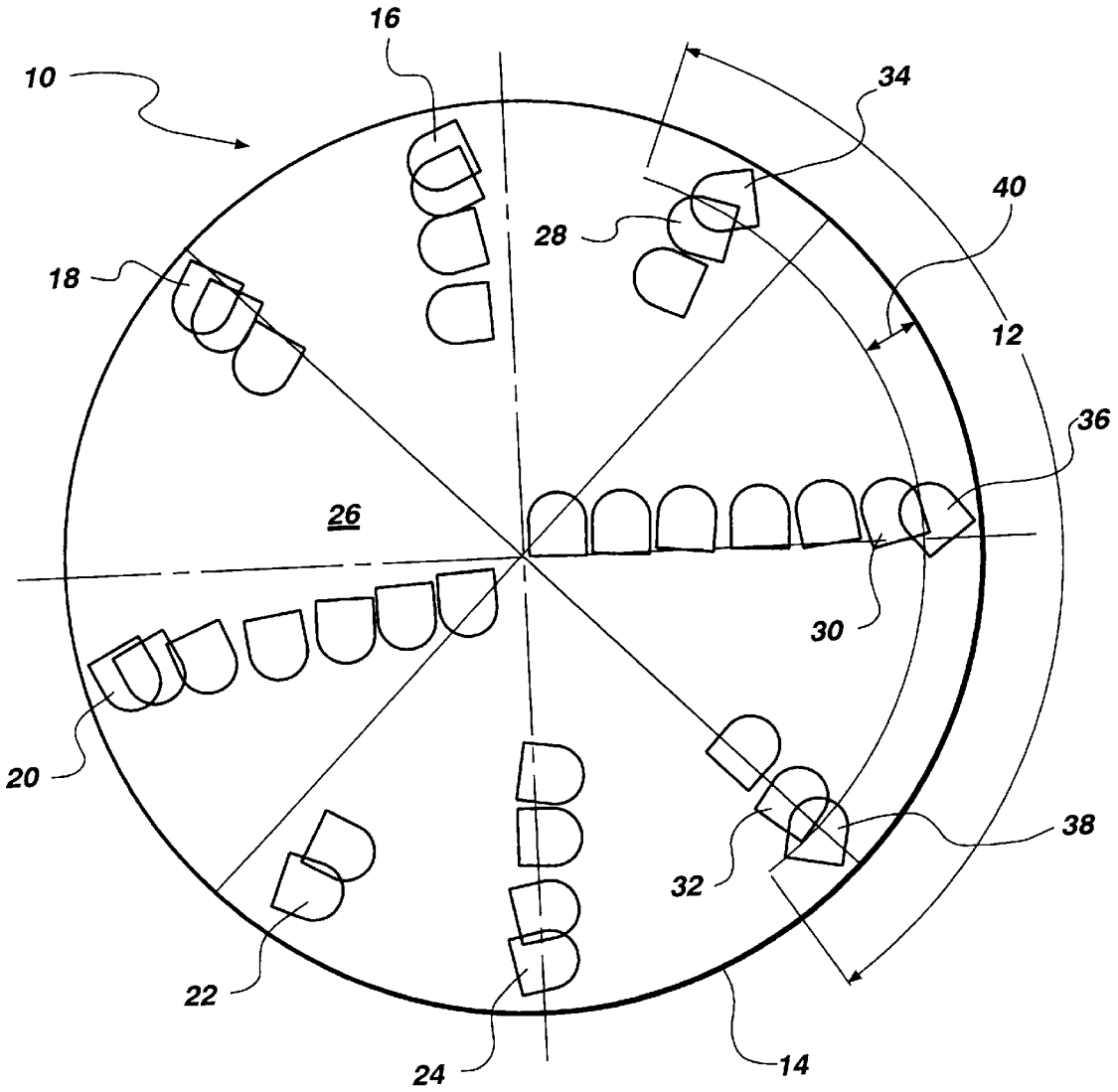
FIG. 1 is a top elevation of an anti-whirl drill bit according to the present invention showing cutter locations.

Referring to FIG. 1 of the drawings, a top elevation (looking downward through the face of the bit) of drill bit 10 showing cutter locations thereon, it will be appreciated that the circumferentially extending bearing zone 12 is, in prior art anti-whirl bits, completely devoid of cutters in proximity to gage 14 of the bit. It should be noted that many of the cutters, depicted in FIG. 1 as cylinders with one rounded end, are unnumbered so as to focus on only those cutters primarily required for a description of the preferred embodiments of the invention. While flank cutters 16, 18, 20, 22 and 24 in the cutting zone 26 comprising the remainder of the bit face are located at or near gage 14, no cutters on the profile flank of the bit face adjacent the bearing zone 12 would extend radially outwardly beyond cutters 28, 30 and 32, which are far removed from gage 14, as can be seen in more detail in FIG. 2, which is a side quarter-section elevation of the bit profile as the bit would be oriented during drilling. Thus, in prior art anti-whirl bits, all of the side loading in the bearing zone 12 would be taken by tungsten carbide pads, diamond inserts, or other non-cutting bearing structures located on gage 14, which structures wear significantly under the radially directed forces focused on the bearing zone 12 according to conventional anti-whirl design theory and practice.

The term "cutting zone" and the use of such term in describing the location of cutters disposed thereon is, as implied above, intended to designate the area of the bit face other than the profile flank adjacent bearing zone 12.

It has been found by the inventors herein, however, that bits which have been used to drill an interval of a bore hole and on which the cutters have worn have reduced whirl tendencies. Further, the tendency of a bit to whirl decreases as the depth of cut of the cutters on the bit increases. For example, lowering the speed of bit rotation or increasing weight on bit to increase depth of cut may reduce whirl tendencies. High rates of penetration, which are usually achieved by an increased depth of cut, also demonstrate reduced whirl tendencies, even on standard bits, as rates approach and exceed 100 ft/hr. Stated in another manner, if, for whatever reason, each cutter on the bit engages the rock formation being drilled so as to take a good "bite" of it, then whirl tendencies of the bit are minimized.

The question then arises as to why anti-whirl designs are desirable. In many, if not most, bore holes being drilled, the characteristics of the formations encountered are not uniform and the bit may achieve a high rate of penetration through one interval and an extremely low rate of penetration through the next. In other cases, relatively soft rock may include extremely hard "stringers" which abruptly and markedly slow the rate of penetration. Since the depth of cut decreases in any instance where the rotational speed of the bit remains the same but the rate of penetration decreases, the result is an increased tendency to whirl. It is impractical to pull a bit and replace it with one more suitable each time a new formation is encountered, even if such changes would be predicted with a high enough degree of accuracy, which is not the case. Further, a bit may begin to whirl in a matter of seconds in response to changing formation characteristics and destroy its cutters in a matter of a few minutes. Therefore, a bit which includes the above-described anti-whirl design concept to prevent cutter destruction in select situations may be extremely desirable, but prior art anti-whirl designs have sacrificed longevity and the ability to support a high rate of penetration over a long drilling interval.

As a result of the recognition of these above-described phenomena, it has been made possible, by judicious bit and cutter design, to specifically address the aforementioned bearing zone wear problem in a manner which will not deleteriously affect the anti-whirl tendencies of a bit designed in accordance with the aforementioned Amoco patents. Stated in another manner, the inventors have developed an anti-whirl bit design in several preferred embodiments which will not affect the anti-whirl characteristics of a new bit or one which is not engaged in reaming or subjected to high depths of cut, coming into play only in such instances where cutting forces adjacent the bearing zone will not stimulate whirl.

Drill bit 10 according to the present invention deploys additional cutters (designated 34, 36 and 38 in FIG. 1) on the profile of the bit adjacent bearing zone 12 of gage 14 in a normally cutter-devoid region 40 on the flank of the bit, such cutters 36–38 providing a cutting action and prevent bearing zone gage wear when cutters 16, 18, 20, 22 and 24 wear or dull or when high side loads on bit 10 increase the depth of cut of cutters 16–24.

Figure 2:
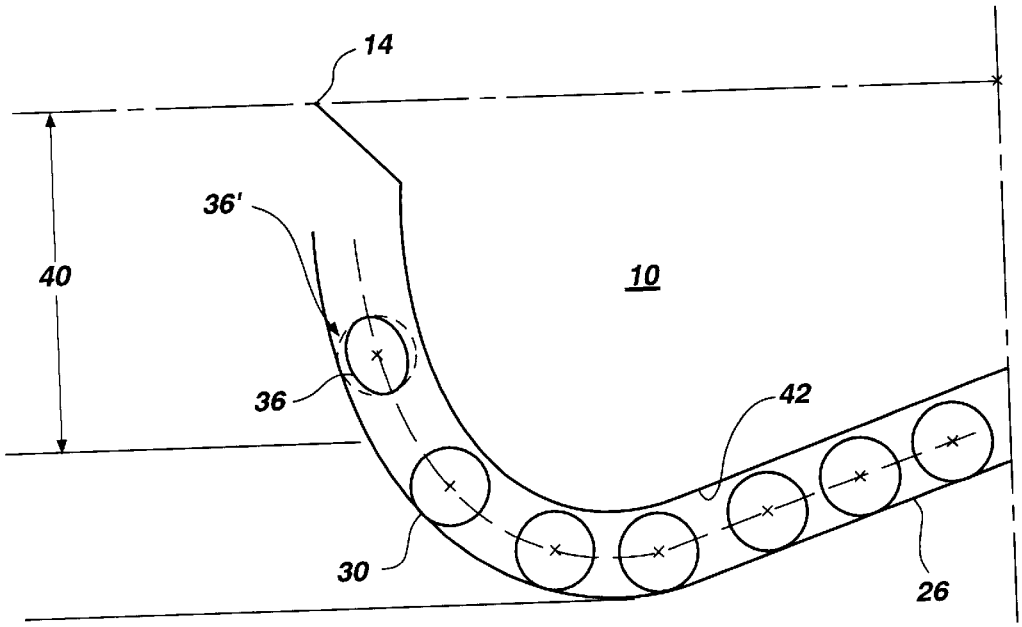
FIG. 2 is a side sectional elevation of a bit profile of the bit of FIG. 1, depicting the increased backrake and reduced height of a flank cutter adjacent the bearing zone with respect to other cutters on the bit profile.

In the embodiment of FIGS. 1 and 2, cutters 34, 36 and 38 in flank region 40 adjacent bearing zone 12 are oriented at a high backrake or negative rake angle to the bit profile 42 so as to maintain these cutters at a reduced height in relation to, for example, cutters 16–24 and out of contact with the formation until cutters 16–24 wear or a high rate of penetration is achieved. Reference in FIG. 2 to traditional cutter placement 36' (if cutter 36 was located in the cutting zone 26) is illustrative of the difference in cutter height and attendant depth of cut.

Figure 3:
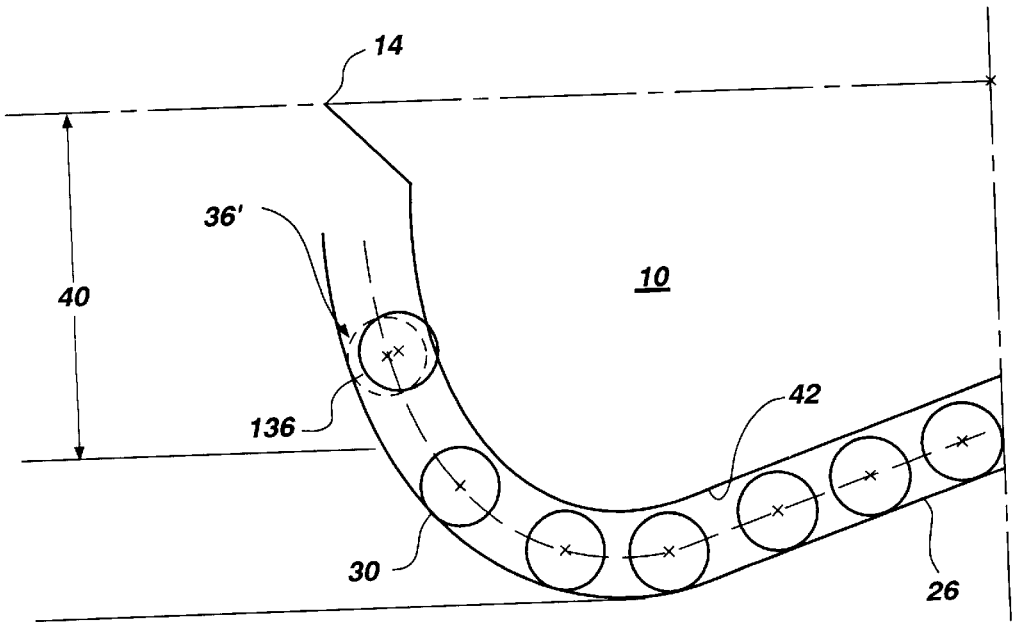
FIG. 3 is a side sectional elevation of an alternative bit design according to the present invention, wherein a flank cutter perpendicular to the profile adjacent the bearing zone is placed so as to protrude a lesser distance from the profile flank than the cutters in the cutting zone of the bit.

In the alternative preferred embodiment of FIG. 3, the face of cutter 136 in flank region 40 is oriented at the same backrake angle as the rest of the cutters on the bit face (for example, 20°), but at a location with respect to the bit profile 42 so as to protrude or extend a lesser distance from the bit profile 42 than if these cutters were located in the cutting zone 26, such as cutters 16–24. Again, as with the embodiment of FIGS. 1 and 2, the bearing zone flank cutter 136, illustrative of others not shown in the profile section of FIG. 3, does not come into play until cutter wear occurs in the cutting zone 26 or a high rate of penetration by bit 10 increases the depth of cut of the cutting zone cutters.

It is also contemplated that the cutters on flank region 40 may also be oriented at a lesser backrake angle than those on the cutting zone 26, and may even be at a neutral rake angle, or perpendicular to the bit profile, as long as the cutter height on the flank region 40 is less than that in the cutting zone 26 flank.

Figure 4:
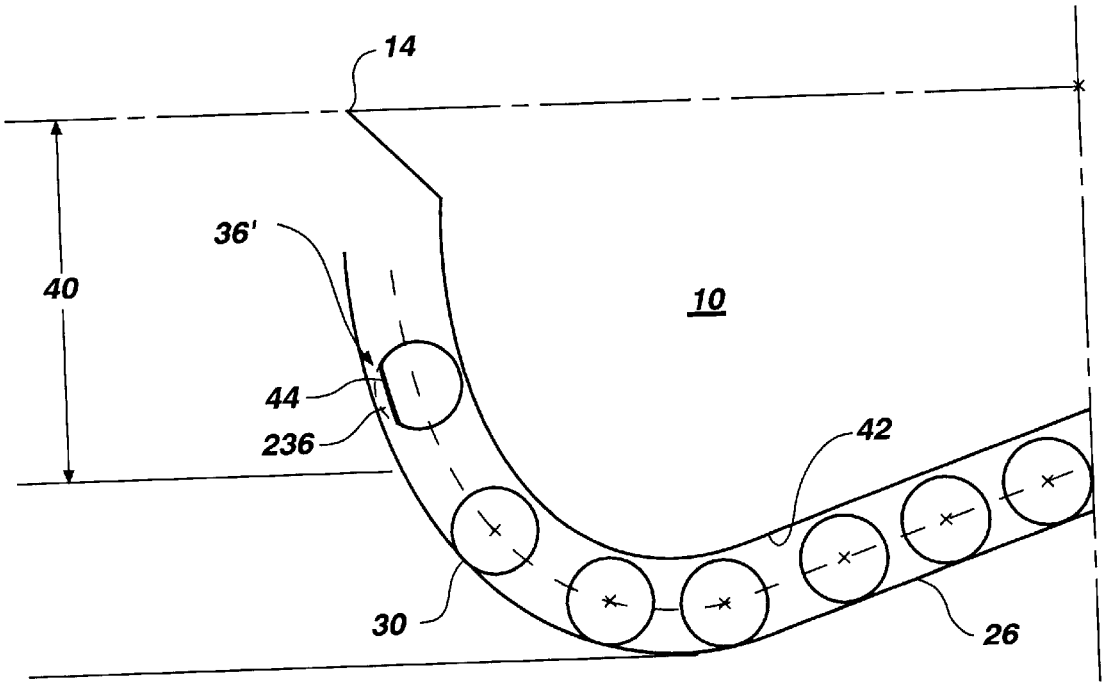
FIG. 4 is a side sectional elevation of a bit profile depicting a flank cutter adjacent the bearing zone and having a grind flat thereon.

Referring to FIG. 4, flank region 40 bearing zone cutter 236 includes a grind flat 44 which reduces the height or extent of protrusion of cutter 236 from bit profile 42 in comparison to that of cutting zone cutters 16–24.

It is believed that a height difference of at least forty thousandths of an inch (0.040") between the bearing zone flank cutters and the cutting zone flank cutters is desirable in a bit according to the present invention, and that a height difference of up to sixty to seventy thousandths inches (0.060–0.070") in new bits is not excessive, as the height difference will initially decrease at a relatively rapid rate due to initial wear of the cutters in the cutting zone.

Figure 5:
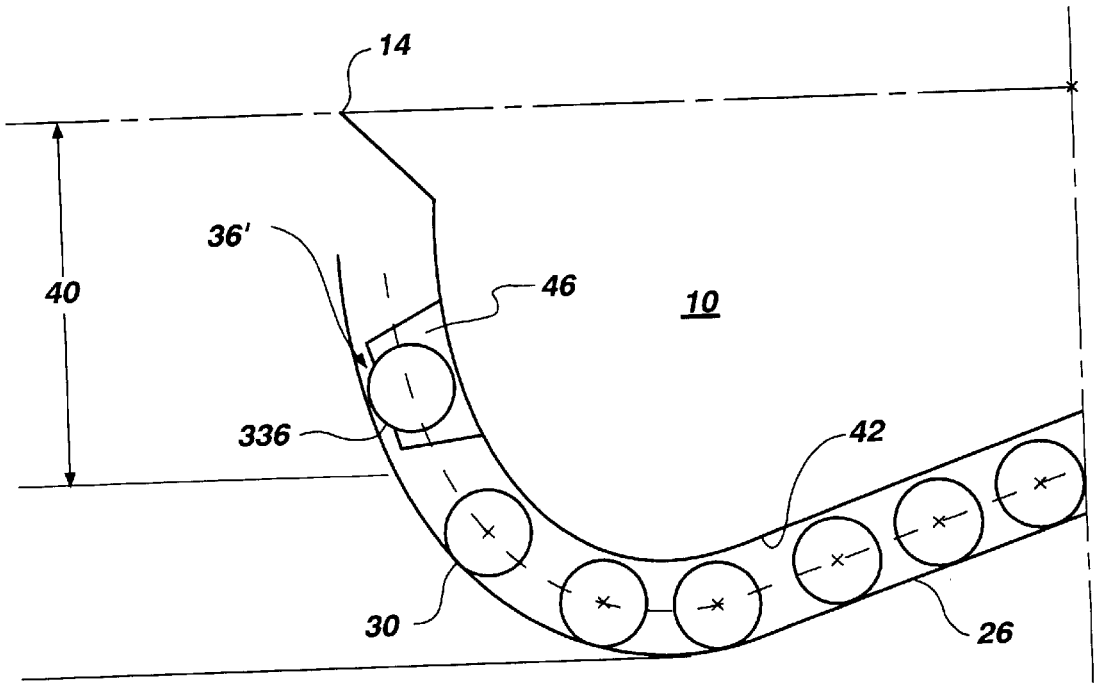
FIG. 5 is a side sectional elevation of a bit profile having a flank cutter adjacent the bearing zone with a schematically shown penetration limiter.

FIG. 5 depicts a full height cutter 336, of traditional cutter placement and similar backrake to cutters 16–24, (e.g., the same as fictitious cutter 36") but with associated penetration limiter 46 which limits the depth of cut adjacent the cutting zone 26 and hence the forces conducive to whirling.

Figure 6:
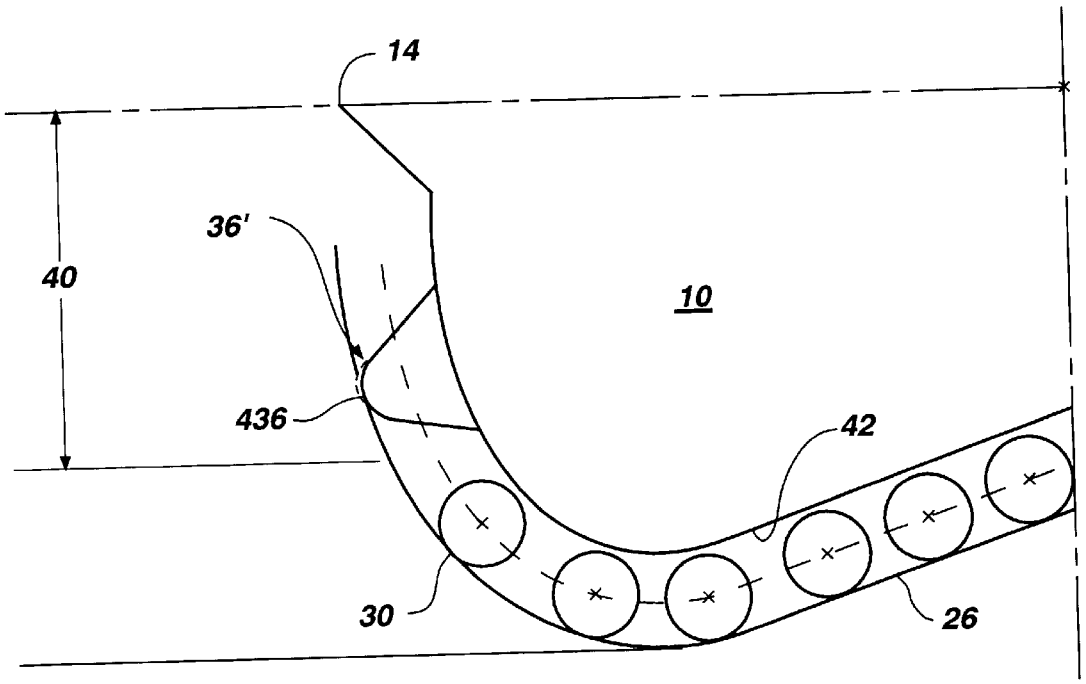
FIG. 6 is a side sectional elevation of a bit profile having a standoff structure on the flank adjacent the bearing zone.

FIG. 6 depicts yet another alternative embodiment of the present invention in the form of wear knots or standoffs 436 on the flank region 40. Such structures may comprise a tungsten carbide stud or insert, bit matrix material or other suitable material known in the art. The stud, insert or matrix material may carry round natural diamonds thereon, have diamond or other superhard material grit disposed therein or define a dome-shaped clad structure such as might be formed by coating a stud, insert or matrix material with a layer or film of diamond or other superhard material. While such structures would perform little, if any, cutting, their presence at the same or a slightly reduced protrusion or height from the bit flank (relative to cutting zone cutters) will, as with the other disclosed embodiments of the invention, reduce wear on the bearing zone. Such a structure effectively extends the bearing area via the use of non-aggressive wear knots or standoffs without extending or increasing the pad area in the bearing zone on the gage. The use of a non-cutting wear knot or standoff as a bearing structure eliminates the need for reduced height or protrusion thereof vis-a-vis the cutting zone cutting elements, as contact of the wear knots or standoffs with the formation will cause them to wear at the same or greater rate than the cutting elements.

It will be appreciated that the use of reduced-height flank cutters, wear knots or other standoff structures on the flank region 40 adjacent the bearing zone achieves a major advantage over prior art anti-whirl bits, even those disclosed in the aforementioned patents which purport to suggest cutters on the bearing pads. Specifically, the tangential cutting forces generated on the profile of the-bit are borne on the same radial plane by the flank cutters, wear knots or other standoff structures of the present invention, thus resisting the tendency of the bit to tilt, cock or wobble in the bore hole. In contrast, the bearing pad cutters suggested by the prior art would not act in the same plane, but above the bit profile (as the bit is oriented in the hole), resulting in a side force at the end of a bending moment arm equal to the longitudinal displacement of the bearing pad cutters from the bit force, which displacement serves to destabilize bit rotation about the longitudinal axis.

Of course, whether or not the bearing pads include cutting structures, the moment arm which resists the side forces generated at the plane of the bit face is detrimental to smooth bit rotation and may cause uneven wear on the bearing pads. The present invention avoids such problems, reduces wear and encourages even wear of the pads in the bearing zone.

Many additions, deletions and modifications to the invention as disclosed and depicted in terms of the preferred and alternative embodiments may be made without departing from the scope of the invention set forth in the following claims. For example, the bearing zone flank cutters may be of reduced height but at the same backrake angle as the cutting zone cutters. On smaller bits, only a single flank cutter adjacent the bearing zone may be employed, or a single wear knot. Wear knots and cutters as described herein may be employed in combination on the flank adjacent the bearing zone.

What is claimed is:

1. An anti-whirl rotary drag bit having an operating life for drilling subterranean formations, wherein a radially-directed force is employed to cause said drag bit to ride on one side thereof against a wall of a borehole being drilled, said drag bit comprising:

a bit body including a bit face having a profile portion and a gage portion at a periphery of said profile portion of said bit face of said bit body, wherein said profile portion includes a flank portion including a first flank region and a second flank region and said gage portion includes a circumferentially-extending bearing zone located thereon on said one side of said bit, said bearing zone located vertically above the second flank region of the flank portion of said profile portion of said bit face;

a cutting zone on said bit body comprising said profile portion of said bit face, with an exception of said second flank region of said flank portion of said profile portion of said bit face;

a first plurality of cutters disposed on said bit face in said cutting zone along one or more radial planes extending across said bit body, said first plurality of cutters protruding a first predetermined distance from said profile portion, said first plurality of cutters generating said radially-directed force at said one side of said bit; and a second plurality of cutters disposed on said second flank region of said flank portion of said profile portion protruding a second predetermined distance from said profile portion, said second predetermined distance being less than said first predetermined distance;

wherein said second plurality of cutters disposed on said second flank region of said flank portion of said profile portion engages portions of said wall of said borehole being drilled, reducing wear of the bearing zone, thereby extending the operating life of said drag bit;

wherein said bearing zone located on said gage portion of said bit body is substantially devoid of cutters.

2. An anti-whirl rotary drag bit having an operating life for drilling subterranean formations, wherein a radially-directed force is employed to cause said drag bit to ride on one side thereof against a wall of a borehole being drilled, said drag bit comprising:

a bit body including a bit face having a profile portion and a gage portion at a periphery of said profile portion of said bit face of said bit body, wherein said profile portion includes a flank portion including a first flank region and a second flank region and said gage portion includes a circumferentially-extending bearing zone located thereon on said one side of said bit, said bearing zone located vertically above the second flank region of the flank portion of said profile portion of said bit face;

a cutting zone on said bit body comprising said profile portion of said bit face, with an exception of said second flank region of said flank portion of said profile portion;

a first plurality of cutters disposed on said bit face in said cutting zone along one or more radial planes extending across said bit body, said first plurality of cutters protruding a first predetermined distance above the profile portion, said first plurality of cutters generating said radially-directed force at said one side of said bit; and at least one flank cutter disposed on said second flank region of said flank portion of said profile portion, said at least one flank cutter having penetration limiting means associated therewith for limiting a depth of cut thereof into said wall of said borehole being drilled into said subterranean formations to a depth less than a depth of cut of said first plurality of cutters;

wherein said at least one flank cutter disposed on said second flank region of said flank portion of said profile portion engages portions of said wall of said borehole being drilled, reducing wear of the bearing zone, thereby extending the operating life of said drag bit; and wherein said bearing zone located on said gage portion of said bit body is substantially devoid of cutters.

3. An anti-whirl rotary drag bit having an operating life for drilling subterranean formations, said drag bit comprising:

a bit body including a bit face portion having a profile extending to a gage portion of said bit body, the gage portion of said bit body located above said bit face portion, said bit face portion extending to said gage portion via an intervening flank portion of said profile of said bit face portion of said bit body, said flank portion including a first flank region and a second flank region, said bit face portion including the first flank region and excluding the second flank region comprising a cutting zone of said drag bit;

a bearing zone located on said gage portion of said bit body at one side of said drag bit, said bearing zone located vertically above the second flank region of the flank portion of said profile of the bit face portion of said bit body, thereby extending above the second flank region on said bit body;

a first plurality of cutters extending from said bit body a first height, said first plurality of cutters being located on the cutting zone of said bit face portion of said bit body, said first plurality of cutters extending along a plurality of radial planes of said bit body extending thereacross, said first plurality of cutters for generating a directed side force vector toward said bearing zone located on said gage portion at said one side of said drag bit by said first plurality of cutters on said cutting zone on said bit face portion including said first flank region of said flank portion engaging portions of said subterranean formations during said drilling thereof; and at least one second cutter located on said second flank region of said flank portion, said at least one second cutter on said second flank region of said flank portion extending therefrom a lesser height than the first height of said first plurality of cutters;

wherein said at least one second cutter located on said second flank region of said flank portion of said bit body engages portions of said subterranean formations during said drilling, reducing wear of said bearing zone located on said gage portion of said bit body, thereby extending the operating life of said drag bit; and wherein said bearing zone located on said gage portion of said bit body is substantially devoid of cutters.

4. An anti-whirl rotary drag bit having an operating life for drilling subterranean formations, said drag bit comprising:

a bit body including a bit face portion having a profile extending to a gage portion of said bit body, the gage portion of said bit body located above said bit face portion, said bit face portion extending to said gage portion via an intervening flank portion of the profile of said bit face portion of said bit body, said flank portion including a first flank region and a second flank region, said bit face portion including the first flank region and excluding the second flank region comprising a cutting zone of said drag bit;

a bearing zone located on said gage portion of said bit body at one side of said bit body, said bearing zone located vertically above the second flank region of the flank portion of said profile of the bit face portion of said bit body, thereby extending above the second flank region on said bit body;

a first plurality of cutters extending from said bit body a first height therefrom, said first plurality of cutters being located on the cutting zone of said bit face portion including said first flank region of said flank portion of said bit face portion of said bit body, said first plurality of cutters extending along a plurality of radial planes of said bit body extending thereacross, said first plurality of cutters for generating a directed side force vector toward said bearing zone located on said gage portion at said one side of said bit body by said first plurality of cutters on said cutting zone on said bit face portion including said first flank region of said flank portion engaging portions of said subterranean formations during said drilling thereof; and at least one wear knot located on said second flank region of said flank portion of the profile of said bit face portion, said at least one wear knot extending therefrom a distance not more than the height of said first plurality of cutters;

wherein said at least one wear knot located on said second flank region of said flank portion of the profile of said bit face portion engages portions of said subterranean formations during said drilling, reducing wear of said bearing zone located on said gage portion of said bit body, thereby extending the operating life of said drag bit; and wherein said bearing zone located on said gage portion of said bit body is substantially devoid of cutters.

5. An anti-whirl rotary drag bit having an operating life for drilling subterranean formations, wherein a radially-directed force is employed to cause said drag bit to ride on one side thereof against a wall of a borehole being drilled, said drag bit comprising:

a bit body including a bit face having a profile portion and a gage portion located therefrom at a periphery of said profile portion of said bit face of said bit body, wherein said profile portion includes a flank portion including a first flank region and a second flank region and said gage portion includes a circumferentially-extending bearing zone on said one side of said bit, said bearing zone located vertically above said second flank region of said flank portion of said profile portion of said bit face;

a cutting zone on said bit body comprising said profile portion of said bit face, with an exception of said second flank region of said flank portion of said profile portion;

a first plurality of cutters disposed on said bit face in said cutting zone, said first plurality of cutters protruding a first predetermined distance above the profile portion; and at least one flank cutter disposed on said second flank region of said flank portion of said profile portion having penetration limiting means associated therewith for limiting a depth of cut thereof into said wall of said borehole being drilled into said subterranean formations to a depth less than a depth of cut of said first plurality of cutters; and wherein said at least one flank cutter disposed on said second flank region of said flank portion of said profile portion engages portions of said wall of said borehole being said bearing zone of said gage portion of said bit face having no cutter mounted therein which would result in a force on said bit being generated by a cutter during said drilling.

* * * * *